US007713409B2

(12) United States Patent
Feimer

(10) Patent No.: US 7,713,409 B2
(45) Date of Patent: May 11, 2010

(54) METHOD FOR REDUCING THE LEVEL OF ELEMENTAL SULFUR AND TOTAL SULFUR IN HYDROCARBON STREAMS

(75) Inventor: Joseph L. Feimer, Bright's Grove (CA)

(73) Assignee: ExxonMobil Research & Engineering Company, Annandale, NJ (US)

( * ) Notice: Subject to any disclaimer, the term of this patent is extended or adjusted under 35 U.S.C. 154(b) by 699 days.

(21) Appl. No.: 11/123,516

(22) Filed: May 6, 2005

(65) Prior Publication Data

US 2006/0011517 A1 Jan. 19, 2006

Related U.S. Application Data

(60) Provisional application No. 60/587,917, filed on Jul. 14, 2004.

(51) Int. Cl.
*C10G 19/04* (2006.01)

(52) U.S. Cl. ..... 208/233; 208/208 R; 208/230; 208/232; 208/231; 208/240

(58) Field of Classification Search ..... 208/233, 208/208 R, 230, 232, 239, 231, 240
See application file for complete search history.

(56) References Cited

U.S. PATENT DOCUMENTS

| | | | | |
|---|---|---|---|---|
| 2,460,227 | A * | 1/1949 | Hart et al. | 208/230 |
| 3,185,641 | A | 5/1965 | Cowden | 208/226 |
| 4,011,882 | A | 3/1977 | Nivens et al. | 137/15 |
| 4,149,966 | A | 4/1979 | O'Donnell et al. | 208/237 |
| 5,160,045 | A | 11/1992 | Falkiner et al. | 210/634 |
| 5,199,978 | A | 4/1993 | Poirier et al. | 208/233 |
| 5,200,062 | A * | 4/1993 | Poirier et al. | 208/236 |
| 5,250,180 | A | 10/1993 | Chang | 210/375 |
| 5,250,181 | A | 10/1993 | Falkiner et al. | 210/634 |
| 5,525,233 | A | 6/1996 | Falkiner et al. | 210/638 |
| 5,618,408 | A | 4/1997 | Poirier et al. | 208/370 |
| 5,674,378 | A | 10/1997 | Kraemer et al. | 208/233 |

FOREIGN PATENT DOCUMENTS

CA 1036054 8/1978

OTHER PUBLICATIONS

Gandhi, H.S., et al., "Effects of sulphur on noble metal automotive catalysts," *Applied Catalysis*, 77 (1991) 175-186, Elsevier Science Publishers B.V.

Gonzales, R.G., et al., "Can you make low-sulfur fuel and remain competitive?" *Hart's Fuel Technology & Management*, 56-61, Nov./Dec. 1996.

* cited by examiner

*Primary Examiner*—Tam M Nguyen
(74) *Attorney, Agent, or Firm*—David M. Weisberg

(57) ABSTRACT

A method for reducing the level of elemental sulfur from sulfur-containing hydrocarbon streams as well as reducing the level of total sulfur in such streams. Preferred hydrocarbon streams include fuel streams such as naphtha streams that are transported through a pipeline. The sulfur-containing hydrocarbon stream is contacted with a mixture of water, a caustic, a surfactant, at least one metal sulfide, and optionally an aromatic mercaptan. This results in an aqueous phase and a hydrocarbon phase containing reduced levels of both elemental sulfur and total sulfur.

11 Claims, No Drawings

METHOD FOR REDUCING THE LEVEL OF ELEMENTAL SULFUR AND TOTAL SULFUR IN HYDROCARBON STREAMS

CROSS REFERENCE TO RELATED APPLICATION

This application claims benefit of U.S. Provisional Patent Application Ser. No. 60/587,917 dated Jul. 14, 2004.

FIELD OF THE INVENTION

This invention relates to a method for reducing the level of elemental sulfur from sulfur-containing hydrocarbon streams as well as reducing the level of total sulfur in such streams. Preferred hydrocarbon streams include fuel streams such as naphtha streams that are transported through a pipeline. The sulfur-containing hydrocarbon stream is contacted with a mixture of water, a caustic, a surfactant, at least one metal sulfide, and optionally an aromatic mercaptan. This results in an aqueous phase and a hydrocarbon phase containing reduced levels of both elemental sulfur and total sulfur.

BACKGROUND OF THE INVENTION

It is well known that elemental sulfur in hydrocarbon streams, such as petroleum streams, is corrosive and damaging to metal equipment. Elemental sulfur and sulfur compounds may be present in varying concentrations in refined petroleum streams, such as in gasoline boiling range streams. Additional contamination will typically take place as a consequence of transporting the refined stream through pipelines that contain sulfur contaminants remaining in the pipeline from the transportation of sour hydrocarbon streams, such as petroleum crudes. The sulfur also has a particularly corrosive effect on equipment, such as brass valves, gauges and in-tank fuel pump copper commutators.

Various techniques have been reported for removing elemental sulfur from petroleum streams. For example, U.S. Pat. No. 4,149,966 discloses a method for removing elemental sulfur from refined hydrocarbon fuel streams by adding an organo-mercaptan compound plus a copper compound capable of forming a soluble complex with the mercaptan and sulfur. The fuel is contacted with an adsorbent material to remove the resulting copper complex and substantially all the elemental sulfur.

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

U.S. Pat. No. 5,618,408 teaches a method for reducing the amount of sulfur and other sulfur contaminants picked-up by refined hydrocarbon products, such as gasoline and distillate fuels, that are pipelined in a pipeline used to transport heavier sour hydrocarbon streams. The method involves controlling the level of dissolved oxygen in the refined hydrocarbon stream that is to be pipelined.

The removal of elemental sulfur from pipelined fuels is also addressed in U.S. Pat. No. 5,250,181 which teaches the use of an aqueous solution containing a caustic, an aliphatic mercaptan, and optionally a sulfide to produce an aqueous layer containing metal polysulfides and a clear fluid layer having a reduced elemental sulfur level. U.S. Pat. No. 5,199,978 teaches the use of an inorganic caustic material, an alkyl alcohol, and an organo mercaptan, or sulfide compound, capable of reacting with sulfur to form a fluid-insoluble polysulfide salt reaction product at ambient temperatures.

Also, U.S. Pat. No. 5,160,045 teaches that the addition of a sulphide to an alkali solution can remove elemental sulfur from hydrocarbon fluids and U.S. Pat. No. 5,250,180 teaches that the addition of an aliphatic mercaptan and a sulphide to an alkali solution can remove elemental sulfur from hydrocarbon fluids. U.S. Pat. No. 5,674,378 teaches the removal of sulfur from a pipelined petroleum stream by contacting the stream with an immiscible treatment comprising water or immiscible alcohol, caustic, a sulfide or hydrosulfide, and optionally a mercaptan. These components are mixed in a co-current mixer.

U.S. Pat. No. 2,460,227 teaches that the addition of $Na_2S$ and an aromatic mercaptan at relatively high concentrations to an alkali solution can remove elemental sulfur from hydrocarbon fluids. However, none of these patents teach the reduction of total sulfur in the hydrocarbon stream while also reducing the elemental sulfur content. In fact, the addition of a sulfur containing species, such as a mercaptan, to the feed under certain conditions results in an increase in total sulfur in the product stream.

While such methods have met with varying degrees of success, there still exists a need in the art for a method capable of reducing the total sulfur content of a hydrocarbon stream while reducing the elemental sulfur content as well.

SUMMARY OF THE INVENTION

In accordance with the present invention there is provided a method for reducing both the level of elemental sulfur and total sulfur of a hydrocarbon stream containing same, which method comprises: (a) mixing with said stream, an aqueous solution consisting of water, a caustic, a surfactant and at least one metal sulfide, thereby resulting in a hydrocarbon phase and an aqueous phase, and (b) separating said aqueous phase and the hydrocarbon phase that is substantially reduced in both elemental sulfur and total sulfur.

In a preferred embodiment, the mixture is passed through a bed of solid particles having a sufficient surface area so that a substantial amount of elemental sulfur is transferred from the hydrocarbon phase to the aqueous phase, followed by separation of the aqueous phase from the hydrocarbon phase. The hydrocarbon phase is now substantially reduced in both elemental and total sulfur.

In another preferred embodiment, an aromatic mercaptan is added to either the hydrocarbon or caustic phase to accelerate the transfer of elemental sulfur from the hydrocarbon phase to the caustic phase. The amount of mercaptan will range from about 1 to about 1000 wppm.

In still another preferred embodiment, the surfactant is selected from the group consisting of phenols, phenol-type compounds, carboxylic acids, amines, polyamines, polyoxyalkylene glycols, and phosphates.

In another preferred embodiment of the present invention the hydrocarbon stream is a naphtha boiling range stream.

In still another preferred embodiment of the present invention the caustic is an inorganic caustic represented by the formula MOH where M is selected from the group consisting of lithium, sodium, potassium, $NH_4$, and mixtures thereof.

In a preferred embodiment, the surfactant is selected from the group consisting of phenols, phenol-type compounds, carboxylic acids, amines, polyamines, carboxylic acid-polyamine complexes, polyoxyalkylene glycols, and phosphates. The surfactant molecule have amphoteric structures containing hydrophillic and hydrophobic ends as outlined in the literature (Lynne, J. L and Bory, B. H., "Surfactants," Kirk Othmer: Encyclopedia of Chemical Technology, 4th Ed., Vol. 23, pp. 478-541, 1997), which is incorporated herein by reference. Surfactants suitable for use herein can be anionic, cationic or nonionic.

In another preferred embodiment of the present invention the metal component in the sulfides is selected from Groups 1a and 2a of the Periodic Table of the Elements. The general formula of the sulfide is $M^{+2}S_x^{-2}$ where M is the Group 1a or Group 2a metal and $S_x$ is the sulfide or polysulfide where x ranges from 1 to about 7. The caustic solution contains at least one metal sulphide.

In yet other preferred embodiments of the present invention the aromatic mercaptan is selected from the group consisting of thiophenol, ethyl thiophenol, methyoxythiophenol, dimethylthiophenol, napthalenethiols, phenyl-di-mercapatan, and thiocresol.

DETAILED DESCRIPTION OF THE INVENTION

Hydrocarbon streams that are treated in accordance with the present invention are preferably petroleum refinery hydrocarbon streams containing elemental sulfur, particularly those naphtha and distillate streams wherein sulfur has been picked-up when the stream is transported through a pipeline. Preferred streams are also those wherein the elemental sulfur is detrimental to the performance of the intended use of the hydrocarbon stream. The more preferred streams to be treated in accordance with the present invention are naphtha boiling range streams that are also referred to as gasoline boiling range streams. Naphtha boiling range streams can comprise any one or more refinery streams boiling in the range from about 10° C. to about 230° C., at atmospheric pressure. Naphtha streams generally contain cracked naphtha that typically comprises fluid catalytic cracking unit naphtha (FCC catalytic naphtha, or cat cracked naphtha), coker naphtha, hydrocracker naphtha, resid hydrotreater naphtha, debutanized natural gasoline (DNG), and gasoline blending components from other sources from which a naphtha boiling range stream can be produced.

FCC catalytic naphtha and coker naphtha are generally more olefinic naphthas since they are products of catalytic and/or thermal cracking reactions. Non-limiting examples of hydrocarbon feed streams boiling in the distillate range include diesel fuels, jet fuels, kerosene, heating oils, and lubes. Such streams typically have a boiling range from about 150° C. to about 600° C., preferably from about 175° C. to about 400° C. Dialkyl ether streams may also be treated in accordance with this invention. Alkyl ethers are typically used to improve the octane rating of gasoline. Such ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, and isopropyl tertiary-amyl ether. Mixtures of these ethers and hydrocarbon streams may also be treated in accordance with this invention.

The hydrocarbon streams treated herein can contain quantities of elemental sulfur as high as 1000 mg per liter, typically from about 10 to about 100 mg per liter, more typically from about 10 to 60 mg per liter, and most typically from about 10 to 30 mg per liter. Such streams can be effectively treated in accordance with this invention to reduce the elemental sulfur content to less than about 10 mg per liter, preferably to less than about 5 mg sulfur per liter, or lower.

The inorganic caustic material that is employed in the practice of this invention are those represented by the formula MOH wherein M is selected from the group consisting of lithium, sodium, potassium, $NH_4$, or mixtures thereof. M is preferably sodium or potassium, more preferably sodium.

As previously mentioned, the surfactant can be anionic, cationic, or nonionic. If it is anionic, it is preferably selected from the group consisting of alkyl sulfates, alkyl ether sulfates, alkylaryl sulfates, alkyl sulfonates, olefin sulfonates including the alpha olefin sulfonates, alkyl ester sulfonates, alkylaryl sulfonates, including the linear and branched alkyl benzene sulfonates and the linear and branched dodecylbenzene sulfonates, alkyl benzenes, sulfonated amides, sulfonated amines, diphenyl sulfonate derivatives, maleic and succinic anhydrides, phosphate esters, phosphorous organic derivaties, sarcosine derivatives, sulfates and sulfonates of oils and fatty acids, sulfates and sulfonates of alcohols and ethoxylated and propoxylated alcohols, alcohol ether sulfates, sulfates and sulfonates of fatty esters, sulfates and sulfonates of ethoxylated and propoxylated alkylphenols including ethoxylated and propoxylated sulfated nonly phenols, sulfated octyl phenols, ethoxylated and propoxylated sulfated octly phenols, sulfated dodecyl phenols, and ethoxylated and propoxylated sulfated dodecyl phenols, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives thereof, and tridecyl and dodecyl benzene sulfonic acids, and mixtures thereof.

If the surfactant is nonionic, then it is preferred that it be selected from the group consisting of alkanolamides, alkanolamines, amine oxides, carboxylic acids, carboxylic fatty acids and carboxylic acid esters, carboxylated alcohols, carboxylated alkylphenols, carboxylated alkylphenol ethoxylates, glycols and glycol esters, ethoxylated and propoxylated glycols and glycol esters, glycerol and glycerol esters, ethoxylated and propoxylated glycerol and glycerol esters, ethoxylated and propoxylated alcohols including ethoxylated and propoxylated primary linear $C_4$ to $C_{20}$+ alcohols, ethoxylated and propoxylated alkylphenols, ethoxylated and propoxylated dodecyl phenols, ethoxylated and propoxylated octyl phenols, ethoxylated and propoxylated nonyl phenols, polyethylene glycols of all molecular weights and reactions, polypropylene glycols of all molecular weights and reactions, glutamic acid and glutamic acid esters, lanolin and lanolin esters, lecithin and lecithin derivatives, monoglycerides, oxazoline and ethoxylated oxazoline derivaties, sorbitan and sorbitan derivatives, soaps of tall oil rosins and fatty acids, sucrose and glucose esters and derivatives, thio and mercapto derivatives, and mixtures thereof.

It is within the scope of this invention that the surfactant be a hydrotropic surfactant, preferably one selected from the group consisting of dicarboxylic acids and acid esters, phosphate esters, sodium xylene sulfonate, sodium dodecyl diphenyl ether disulfonate, and maleic and succinic anhydrides, and mixtures thereof.

The sulfide component used in the practice of the present invention includes at least one mono sulfides and polysulfides of metals from Groups 1a and 2a of the Periodic Table of the Elements, such as the one found in the inside front cover of the $55^{th}$ edition of the Handbook of Chemistry and Physics, 1974-1975, CRC Press. Group 1a metals include Li, Na, and K; and Group 2a metals include Be, Mg, and Ca. Non-limiting examples of such sulfides include $Na_2S$, $Na_2S_4$, K2S, $Li_2S$, NaHS, $(NH_4)_2S$, and the like. $Na_2S$ is preferred. The sulfide in caustic reacts with the elemental sulfur in the hydrocarbon stream to be treated to form polysulfides in caustic. Lower molecular weight polysulfides in caustic will react with elemental sulfur to form higher molecular weight polysulfides. The sulfide may be present in a convenient source of caustic such as white liquor from paper pulp mills. Thus, the elemental sulfur moves from the hydrocarbon stream to the aqueous caustic phase.

Aromatic mercaptans can be employed in the practice of the present invention to improve performance. These mercaptans, in the presence of caustic, form a sulfur complex that transfers easily into the fuel to react with the elemental sulfur, thereby accelerating sulfur removal from the hydrocarbon stream. The aromatic mercaptans that can be used in the practice of the present invention include a wide variety of compounds having the general formula RSH, where R represents an aromatic group. Non-limiting examples of such aromatic mercaptans include: thiophenol, ethyl thiophenol, methyoxythiophenol, dimethylthiophenol, napthalenethiols, phenyl-di-mercaptans, and thiocresol. Most preferred is thiophenol.

The proportion of water, caustic, surfactant, sulfide, and optional aromatic mercaptan is an effective amount that will allow a predetermined quantity of elemental sulfur to react with the sulfide and transfer from the hydrocarbon phase to the aqueous phase. This proportion may vary within wide limits. Typically, the aqueous treating solution contains caustic in the range of about 0.01 to 20M, with surfactant concentration ranging from about 0.0001 wt. % to about 50 wt. %, preferably from about 0.001 wt. % to about 1 wt. % and with sulfide concentration being from about 0.1 wt. % to about 30 wt. %, preferably 0.2 wt. % to 2 wt. %. The amount of aromatic mercaptan, if used, will be from about 1 wppm to about 1,000 wppm, preferably from about 1 wppm to about 100 wppm in either the caustic or hydrocarbon stream. The relative amount of aqueous treating solution containing caustic, metal sulfide, and optionally the aromatic mercaptan and the hydrocarbon stream to be treated may also vary within wide limits. Usually from about 0.000001 to about 10, preferably from about 0.000001 to about 1.0 volumes of aqueous treating solution will be used per volume of hydrocarbon stream to be treated.

The aqueous phase may be dispersed within the hydrocarbon stream by any suitable mixing device that will provide effective mixing. By "effective mixing" we mean that the mixing will provide enough energy to result in a discontinuous aqueous phase dispersed in the hydrocarbon phase. The discontinuous phase will be comprised of finely dispersed droplets of aqueous solution in the continuous hydrocarbon phase. Non-limiting examples of mixing devices include in-line mixers, a dispersion devices and a batch mixers as disclosed in U.S. Pat. No. 5,674,378, which is incorporated herein by reference.

Treating conditions that can be used in the practice of the present invention are effective conditions in the conventional range. That is, the contacting of the hydrocarbon stream to be treated is preferably effected at ambient temperature conditions, although higher temperatures up to about 200° C., or higher, may be used. Substantially atmospheric pressures are suitable, although higher pressures may, for example, range up to about 1,000 psig. Contact times may also vary widely depending on such things as the hydrocarbon stream to be treated, the amount of elemental sulfur therein, and the composition the treating solution. The contact time should be chosen to affect the desired degree of elemental sulfur conversion. The reaction proceeds relatively fast, usually within several minutes, depending on solution strengths and compositions. Contact times will range from about a few seconds to a few hours.

In general, the process of the present invention involves the addition to the hydrocarbon stream to be treated of a mixture of effective amounts of caustic, water, surfactant and sulfide. The mixture is allowed to settle so as to form an aqueous layer containing metal polysulfides and a clear hydrocarbon stream layer having a reduced level of both elemental sulfur and total sulfur. The use of a surfactant improves the contacting of the two phases and thus enhances the transfer of the sulfur species from the hydrocarbon phase to the aqueous phase. The treated hydrocarbon stream can be recovered by any suitable liquid/liquid separation technique, such as by decantation or distillation. The recovered aqueous layer may be recycled back to the mixing zone for contact with the hydrocarbon stream to be treated, or it may be discarded or used, for example, as a feedstock to pulping paper mills, such as those employing the Kraft pulp mill process. The hydrocarbon phase can further be water washed to remove an residual caustic.

The instant invention will typically be practiced by blending an immiscible water/alkali-metal/surfactant/sulfide mixture with the sulfur-containing hydrocarbon stream to be treated. An effective amount of an aromatic mercaptan can be added to either the hydrocarbon phase or the aqueous phase for improved performance. The hydrocarbon and aqueous solutions are blended in a suitable mixing device.

The sulfide concentration in the aqueous solution is from about 0.1 wt. % to about 30 wt. %, or as allowed by precipitation limits.

The following examples are illustrative of the invention and are not to be taken as limiting in any way.

EXAMPLE 1

A ¾" diameter by 3-foot long stainless steel (SS) vessel was packed with 200 cc (155 gms) of 14×28 mesh Alcan alumina AA400G. A 100 mesh SS support screen was added to each end of the vessel to help contain the alumina within the vessel. The packed bed of alumina was flooded with 200 mls of an aqueous solution of 19 wt. % NaOH and 1.5 wt. % $Na_2S$ and then allowed to drain from the packed-bed by gravity. Diesel was then pumped at 10 cc/min to the top of the packed bed while the vessel was operated at about 20° C. The superficial velocity and residence time of the gasoline in the packed bed was 0.15 fpm (feet per minute) and 20 minutes, respectively. A sample of diesel from the effluent of the packed bed was taken after 6 hours to determine the elemental sulfur by polarography.

EXAMPLE 2

200 wppm of Lubrizol 539S that contains a carboxylic acid based surfactant was added to a diesel. The diesel containing the surfactant was pumped at 10 cc/min to the top of the packed bed of alumina from Example 1 while the vessel was operated at about 20° C. The superficial velocity and residence time of the gasoline in the packed bed was 0.2 fpm and 20 minutes, respectively. A sample of diesel from the effluent of the packed bed was taken after 8 hours to determine the elemental sulfur by polarograph.

Table 1 compares the packed-bed performance with a diesel hydrocarbon stream. Examples 1 and 2 demonstrate that the addition of a surfactant to the diesel hydrocarbon stream significantly improves the ability of the packed bed to remove elemental sulfur.

TABLE 1

| | Example | |
|---|---|---|
| | 1 | 2 |
| Packed Bed | Alumina | Alumina |
| Hydrocarbon Feed | Diesel | Diesel With Surfactant |
| Aqueous Solution | $NaOH/Na_2S$ | $NaOH/Na_2S$ |
| Aqueous solution-to-Hydrocarbon Ratio, vol. % | 0.5% | 0.5% |
| Residence Time, min. | 20 | 20 |
| Superficial Velocity, fpm | 0.15 | 0.15 |
| Mixing Device | In-line (10 × 150 mesh) | In-line (10 × 150 mesh) |
| Mixing Energy, hp/kusgal | ~1 | ~1 |
| Feed Elemental Sulfur, mg/l | 17.9 | 16.8 |
| Product Elemental Sulfur, mg/l | 16.4 | 5.8 |
| Elemental Sulfur Removal, % | 8 | 65 |

The invention claimed is:

1. A method for reducing both the level of elemental sulfur and total sulfur of a hydrocarbon stream containing same, which method comprises:

(a) mixing with said stream, water, a caustic represented by the formula MOH where M is selected from the group consisting of lithium, sodium, potassium, $NH_4$, and mixtures thereof, a carboxylic acid surfactant, at least one metal sulfide of a metal selected from Groups 1a and 2a of the Periodic Table of the Elements, and at least one aromatic mercaptan, the resulting mixture having a hydrocarbon phase and an aqueous phase, wherein said mixture is used in an effective amount and under effective conditions so that the elemental sulfur reacts with said at least one metal sulfide to form the corresponding metal polysulfide that is soluble in the aqueous phase; and (b) separating said aqueous phase containing said metal polysulfide component, and said hydrocarbon phase that is substantially reduced in both elemental sulfur and total sulfur.

2. The method of claim 1 wherein the hydrocarbon stream is a naphtha boiling range stream.

3. The method of claim 1 wherein the caustic is used in the range of about 0.01 to 20 molar.

4. The method of claim 1 wherein the sulfide is selected from the group consisting of $Na_2S$, $Na_2S_4$, $K_2S$, $Li_2S$, NaHS, $(NH_4)_2S$, and mixtures thereof.

5. The method of claim 4 wherein the sulfide is used in range of about 0.1 wt. % to about 5 wt. %.

6. The method of claim 1 wherein the at least one aromatic mercaptan is selected from the group consisting of thiophenol, ethyl th iophenol, methyoxythiophenol, dimethyithiophenol, naphtaleneth iols, phenyl-di-mercapatan, and thiocresol.

7. The method of claim 6 wherein the at least one aromatic mereaptan is present in a range from about 1 to about 1000 wppm.

8. The method of claim 1 wherein the at least one aromatic mercaptan is added to the hydrocarbon stream.

9. The method of 1 wherein the at least one aromatic mercaptan is added to the aqueous phase.

10. The method of claim 1 wherein the aqueous phase is from about 0.05 to about 10 times the volume of the hydrocarbon phase.

11. The method of claim 10 wherein the aqueous phase is from about 0.1 to about 10 times the volume of the hydrocarbon phase.

* * * * *